US005302260A

United States Patent [19]

LeRoy et al.

[11] Patent Number: 5,302,260

[45] Date of Patent: Apr. 12, 1994

[54] GALVANIC DEZINCING OF GALVANIZED STEEL

[75] Inventors: Rodney L. LeRoy; M. Barakat I. Janjua, both of Pointe-Claire, Canada

[73] Assignee: Noranda Inc., Toronto, Canada

[21] Appl. No.: 773,532

[22] Filed: Oct. 9, 1991

[30] Foreign Application Priority Data

Oct. 15, 1990 [CA] Canada ..... 2027656

[51] Int. Cl.[5] ..... C25F 5/00

[52] U.S. Cl. ..... 204/144; 204/145 R; 204/146; 204/116; 204/118

[58] Field of Search ..... 204/144, 116, 146, 145 R, 204/248, 249, 118

[56] References Cited

U.S. PATENT DOCUMENTS

| | | | |
|---|---|---|---|
| 2,241,585 | 5/1941 | Day, Jr. | 204/146 |
| 2,307,625 | 1/1943 | Gregory | 23/97 |
| 2,578,898 | 12/1951 | Orlik | 204/146 |
| 2,596,307 | 5/1952 | Stuffer | 204/146 |
| 3,394,063 | 7/1968 | Blume | 204/146 |
| 3,492,210 | 1/1970 | Bowers et al. | 204/146 |
| 3,619,390 | 11/1971 | Dillenberg | 204/146 |
| 3,634,217 | 1/1972 | Bedi et al. | 204/146 |
| 3,649,491 | 3/1972 | Bowers et al. | 204/146 |
| 3,905,882 | 9/1975 | Hudson et al. | 204/119 |
| 4,183,790 | 1/1980 | Janjua et al. | 204/48 |
| 5,106,467 | 4/1992 | Leeker et al. | 204/114 |

FOREIGN PATENT DOCUMENTS

| | | | |
|---|---|---|---|
| 870178 | 5/1971 | Canada . | |
| 8402924 | 4/1986 | Netherlands | 204/146 |

OTHER PUBLICATIONS

Zoubov et al., "Zinc", Atlas of Electrochem. Equilib., pp. 406–413.

Janjua et al., "Electrocatalyst Performance . . . ", Int. J. Hydrogen Energy, vol. 10, No. 1, pp. 11–19, 1985.

Bowen et al., "Developments in Advanced Alkaline . . . ", Hydrogen Energy, vol. 9, No. 12, pp. 59–66, 1984.

Merrill et al., "Experimental Caustic Leaching of Oxidized . . . " U.S. Dept. of Int., Br. of Mines, Rpt. of Invest. 6576, 1964.

P. Scolieri, American Metal Market, Apr. 18, 1990, p. 3.

*Primary Examiner*—John Niebling
*Assistant Examiner*—Arun S. Phasge
*Attorney, Agent, or Firm*—Keck, Mahin & Cate

[57] ABSTRACT

A method of removing zinc from galvanized steel without substantial co-dissolution of substrate iron comprises immersing the galvanized steel in a caustic electrolyte solution, and electrically connecting the galvanized steel to a cathode material which is stable in caustic electrolyte and has a low hydrogen overvoltage.

10 Claims, 3 Drawing Sheets

GALVANIC DEZINCING OF GALVANIZED STEEL

FIELD OF THE INVENTION

This invention relates to a method of removing zinc from galvanized steel.

BACKGROUND OF THE INVENTION

Over half of North American zinc shipments are used for the production of galvanized steel. There is a significant scrap rate in mills producing galvanized sheet (this can be on the order of 15 to 20%), and the scrap rate in the plants of primary fabricators of galvanized sheet can be as high as 25% or more. Thus, over one million tons of fresh galvanized scrap are produced each year.

Galvanized scrap is normally purchased by steel mills at a substantial discount to non-galvanized material. This discount is necessary because the galvanized scrap must be fed to melting furnaces where the zinc vaporizes and is trapped in the flue dust, with the result that this flue dust cannot be easily sold or recirculated to the furnace. Further, there are now environmental constraints on disposal of zinc containing dusts as land-fill. Also, feeding excessive amounts of galvanized scrap to basic oxygen steel-making furnaces (BOF) can result in costly shut-downs for cleaning and refractory repair. Thus, there is great interest in development of an economical method of removing zinc from galvanized scrap. Although no process has been transferred as of now to successful commercial practice, at least six approaches have been described:

a) Dissolution of Zinc with Pickle Liquor

Pickle liquor discharged from de-scaling steel products can be contacted with scrap galvanized steel to remove zinc in 5 to 10 minutes. Both sulfuric acid and hydrochloric acid have been used in this process. However, the major problem lies in the separation of iron which is co-dissolved with zinc in the acid solution An economically feasible method for this step has not yet been found.

b) Dissolution with Ammonium Carbonate Solution

In this process galvanized steel scrap is contacted with ammonium carbonate solution containing an excess of ammonia at about 170° C. Zinc dissolution is achieved in approximately 6 hours, compared with about 15 hours at room temperature. The resulting zinc ammonium carbonate complex solution is stripped of ammonia and carbon dioxide by steam injection, and zinc carbonate is precipitated. Heating of the zinc carbonate produces zinc oxide. The ammonia and carbon dioxide evolved are utilized to regenerate the original leaching solution. The major drawback to this procedure is the process time required This implies high capital and processing costs, and thus makes this procedure unattractive economically.

c) Dissolution of Zinc with Caustic Soda

Dissolution of zinc from galvanized scrap in a caustic soda solution is considered to be more economical than either of the two preceding alternatives An inherent advantage of this method is that the underlying iron layer is stable in caustic, and as a result zinc/iron separation after treatment is not a major problem. However, in this method the zinc/iron alloy layer is not readily dissolved and, as this layer is of variable thickness depending on the method of galvanizing, both zinc recovery and the zinc removal rate are variable. Insufficient zinc removal in some cases results in a product which is not much better than the starting material. Further, the process can be exceedingly slow, making it uneconomic in industrial practice.

d) Recovery as Zinc Chloride

In a process developed by Dupont (Gregory, J.E., "Chemical Processes for Dezincing Galvanized Scrap", U.S. Pat. No. 2,307,625, Jan. 5, 1943), zinc is dissolved from galvanized scrap in a zinc chloride solution containing a small amount of hydrochloric acid. In this method, iron dissolution is kept to a minimum by the use of suitable organic inhibitors, and the zinc is later recovered by boiling to precipitate zinc oxide. This and related processes have proved to be uneconomical, because of their complexity and the resulting large amount of handling which is required. A further problem is the incompatibility of chloride-containing secondaries with conventional zinc electrorefineries.

e) Acceleration of Zinc Removal with Oxidizing Agents

Dissolution of zinc from galvanized steel in caustic electrolyte, as described above, can be accelerated by addition to the electrolyte of oxidizing agents such as hydrogen peroxide, oxygen, or nitrate compounds such as sodium nitrate. All of these additives, however, have drawbacks which impede their being used in practice Hydrogen peroxide is costly, making the process uneconomic. Oxygen accelerates the rate of zinc dissolution somewhat, but not enough to make the process economic. Use of nitrates entails costly provisions for maintaining constant chemistry in the treatment electrolyte; further, formation of cyanides has been reported from reaction with oils which can be present on galvanized scrap.

f) Power-Assisted Removal in Caustic Electrolyte

Numerous patents have described methods for dissolution of a coating layer of metal from an underlying base metal, based on use of an external source of voltage to pass current through the treatment bath (Canadian patent 870,178; U.S. Pat. Nos. 2,578,898, 2,596,307, 3,394,063, 3,492,210, 3,619,390, 3,634,217, and 3,649,491). A recent announcement in *American Metal Markets* (Apr. 18, 1990, page 3) describes piloting of a process of this type in which zinc has been removed from bundles of galvanized steel of four types: hot-dipped; electrolytic; galvalume; and galvannealed. While this appears to be the most practical of the procedures described above, it suffers from three fundamental problems. First, costly electric power must be used to strip the zinc from the galvanized steel; at typical power rates this cost can be on the order of $10 to $15 per ton of scrap. Also, rectifiers, conductors, breakers and related equipment add significantly to the installed cost of a dezincing facility. Secondly, substrate iron dissolves as zinc dissolution nears completion; it is very difficult in practice to avoid significant co-dissolution. Thirdly, the dissolved zinc, iron and other impurities deposit directly on the cathodes which are used to promote electrolytic dissolution. The resulting deposits are impure, reducing their economic value and limiting options for further purification and recycling of the zinc.

SUMMARY OF THE INVENTION

The present invention is based on galvanic dissolution of zinc from galvanized steel in caustic electrolytes, but it avoids all three of the limitations described above in connection with zinc dissolution using imposed current.

Being a very electronegative metal, zinc is thermodynamically unstable in the presence of water and aqueous solutions, tending to dissolve with the evolution of hydrogen in acid or alkaline solutions. Iron is unstable in aqueous solutions below a pH of 7 to 9, dissolving readily as ferrous ions. At higher pH's, however, iron is almost immune to corrosion, with dissolution to dihypoferrite ion ($HFeO_2-$) or oxidation to magnetite ($Fe_3O_4$) or ferrous hydroxide ($Fe(OH)_2$) occurring only very slowly. Thus, in accordance with the present invention zinc is removed from galvanized steel without significant co-dissolution of the underlying iron by immersing the galvanized steel in a caustic solution. In fact, the practice of this invention is preferably limited to solutions of pH greater than 11, in order to avoid limitations on the reaction rate which would result due to formation of zinc oxide or zinc hydroxide on the zinc metal. Also, pH values less than 15.5 are preferred, in order to minimize dissolution of iron from the galvanized steel substrate.

When a piece of galvanized steel is immersed as has been described above in an aqueous solution having a pH between 11 and 15.5, local electrochemical cells are established with zinc dissolving anodically as bizincate ion ($HZnO_2-$) or zincate ion ($ZnO_2-$), and hydrogen evolving on cathodic sites. The potential difference is between 450 and 600 mV, with the exact value depending upon the concentration of bizincate or zincate ion in solution. However, this reaction often takes place extremely slowly when the zinc is pure, because of the large overpotential for the evolution of hydrogen on zinc. For example, in an experiment it was found that a sample of galvanized steel sheet having a zinc coating of 1.25 ounces per square foot did not significantly change in appearance after being immersed in a 20% sodium hydroxide solution at 60° C. for 16 hours. A regular, but very slow rate of evolution of hydrogen was observed on the galvanized surface in this experiment. This process results in some consumption of caustic, according to the following equations:

| | | |
|---|---|---|
| Anodic - | $Zn + 4OH^- \rightarrow ZnO_2^{--} + 2H_2O + 2e^-$ | (1) |
| Cathodic - | $2e^- + 2H_2O \rightarrow H_2 + 2OH^-$ | (2) |
| Overall - | $Zn + 2OH^- \rightarrow ZnO_2^{--} + H_2$ | (3) |

The caustic consumption is 1.2 kg of caustic soda (NaOH), or 1.7 kg of caustic potash (KOH), for each kilogram of zinc which is dissolved.

It is known that the corrosion of pure zinc in aqueous solutions can be greatly accelerated if the zinc is put in contact with a metal of low hydrogen overvoltage such as platinum (M. Pourbaix, "*Atlas of Electrochemical Equilibria*", National Association of Corrosion Engineers, Houston, 1974, p. 409). The applicant has discovered that this phenomenon can be the basis of a practical and economic method for removing zinc from galvanized steel scrap.

In essence, the method in accordance with the present invention advantageously further comprises the step of contacting the steel from which zinc is to be removed in caustic electrolyte with a cathode material which is stable in caustic electrolyte and is characterized by a low overvoltage for the evolution of hydrogen The method has all the desired characteristics of a commercial process:

No external source of power is required.

Dissolution of iron is negligible, as there is no external voltage source or oxidizing agent.

Economic rates of zinc dissolution can be achieved.

Zinc bearing solutions resulting from the process can be purified to allow production of a high-value zinc product.

The driving force for the galvanic dezincing of this invention is the potential difference between the electrode reactions for anodic zinc dissolution (equation (1) above; see Pourbaix, cited above), $$E_o = 0.441 - 0.1182\ (T/298)pH + 0.0295\ (T/298) \log [ZnO_2-],$$

and for cathodic hydrogen evolution (equation (2) above), $$E_o = -0.0591\ (T/298)pH,$$

where T is the temperature in Kelvin. For example, at an electrolyte temperature of 60° C. and a pH of 14.8 (corresponding to a caustic soda concentration of 250 gpl), the driving potential calculated from these expressions is 0.55 V.

As dezincing progresses, the total current I in amperes is determined by the equation $$Driving\ Potential = IR + \eta_{H2} + \eta_{Zn}$$

where

R is the resistance in ohms or the electrolyte between the cathode material and the scrap being dezinced, $\eta_{H2}$ is the hydrogen overvoltage in volts on the cathode material, and $\eta_{Zn}$ is the overvoltage in volts for zinc dissolution.

The overvoltage for zinc dissolution is small, typically less than 50 mV. Also, the hydrogen overvoltage on suitable active cathode materials is typically 75 mV, and is normally less than 100 mV at the current densities which would be used in dezincing. Both overvoltages depend on current density, but this effect can be neglected to a first approximation. Approximating the total of the anodic and cathodic overvoltages as 150 mV, a total of 400 mV is typically available to drive the flow of zinc dissolution current between the anodic scrap and the cathode material. This driving voltage is reduced somewhat when commercial galvanized coatings such as nickel-zinc or galvannealed (iron-zinc) are being stripped.

The cathodes which may be effectively used in this invention are the same class of materials which can be economically used in the alkaline electrolysis of water, as described for example by Janjua and LeRoy in "*Electrocatalyst Performance in Industrial Water Electrolysers*", Int. J. Hydrogen Energy, Vol. 10, No. 1, pp 11-19, 1985 and by Bowen et al. in "*Developments in Advanced Alkaline Water Electrolysis*", Int. J. Hydrogen Energy, Vol. 9, No. 12, pp 59-66, 1984. The active cobalt cathode material described by Janjua and LeRoy in U.S. Pat. No. 4,183,790 has also proven effective in short-term tests, although it loses activity on long-term use. The most successful cathode materials for long-term commercial use are high-surface-area nickel-based materials, for example of the Raney nickel type. High-surface-area cobalt-based materials, for example of the Raney cobalt type may also be used. Other suitable cathode materials are nickel molybdates, nickel sulfides, nickel-cobalt thiospinels and mixed sulphides, nickel aluminum alloys, and electroplated active cobalt compositions.

BRIEF DESCRIPTION OF THE DRAWINGS

The invention will now be disclosed, by way of example, with reference to the following examples which refer to accompanying drawings in which.

DETAILED DESCRIPTION OF THE PREFERRED EMBODIMENTS

Example 1

Figure 1:
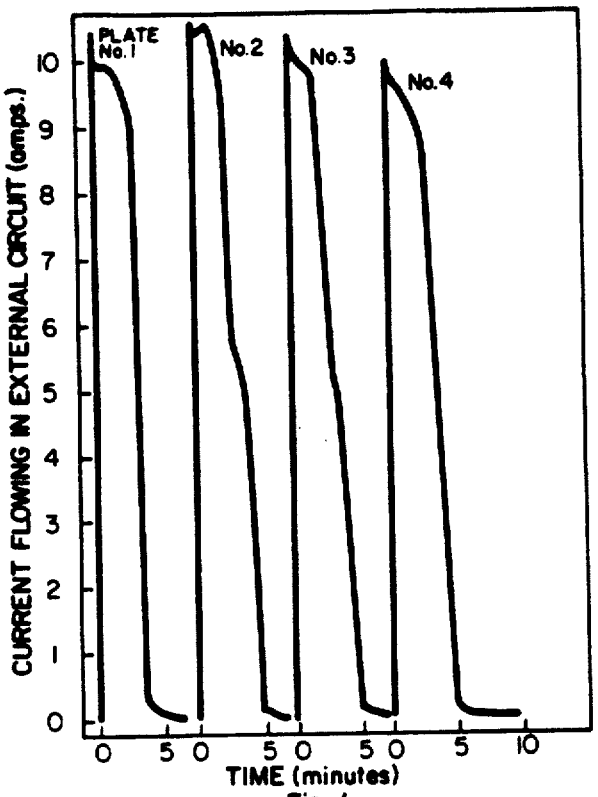
FIG. 1 illustrates the current flowing in an external circuit when various galvanized steel samples are coupled to two active cobalt cathodes.

In order to establish quantitatively the zinc dissolution rate by the method of this invention, experiments were performed as follows. A galvanized sheet sample was coupled through a 0.001-ohm resistor to sheets of the cathode material, which were mounted on either side of the galvanized sample. A recorder was connected across the resistor, and the electrode array wa immersed in the caustic electrolyte. FIG. 1 illustrates a typical record of the current which flows from the time of immersion to the time of complete zinc removal. In this case, the active-cobalt cathodes of U.S. Pat. No. 4,183,790 Were used. 1½ inch ×6 inch galvanized samples were mounted immersed in 20% sodium hydroxide electrolyte to a depth of four inches, between active cathodes of equal size. Electrolyte temperature was 60° C. This experiment was repeated four times in the same 900 ml of electrolyte. The average dissolution rate in these experiments corresponded to a current of approximately 10 amperes, indicating a dissolution rate of 2.4 grams per square foot per minute. In each case, removal of the zinc coating was more than 99.5% complete within 5 minutes.

Example 2

Effect of Temperature—Experiments similar to those reported in Example 1 were carried out at 30° C., 45° C., 60° C. and 75° C. The electrolyte volume used was 330 ml.

The results are characterized by three parameters: the time required for complete zinc dissolution, the time required for dissolution of 50% of the zinc coating, and the current flowing 12 seconds after immersion of the electrode array.

Figure 2:
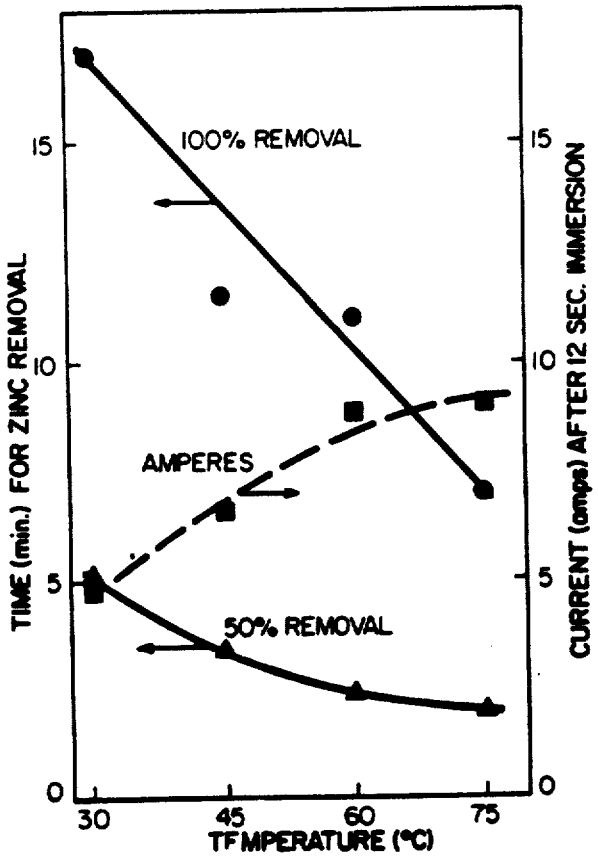
FIG. 2 illustrates the dependence of the rate of zinc dissolution on electrolyte temperature.

The variation of each of these parameters with temperature is indicated in FIG. 2. For each experiment (at each temperature) a fresh NaOH solution was prepared, in order to eliminate effects due to build-up of the zincate concentration, which increased during each experiment from 0 to 4.6 gpl sodium zincate.

The sodium hydroxide concentration in these experiments was held constant at 200 gpl. This decreases slightly during each experiment due to hydroxide ion consumption in the formation of zincate ion, the net consumption being approximately 0.95 grams NaOH per experiment.

The results (FIG. 2) show that a temperature increase from 30° C. to 60° C. has a very strong effect in accelerating the zinc dissolution reaction. Further temperature increase to 75° C. also accelerates the rate, but by a decreased amount. This indicates that the optimum temperature of operation lies between 60 and 75° C.

Example 3

Figure 3:
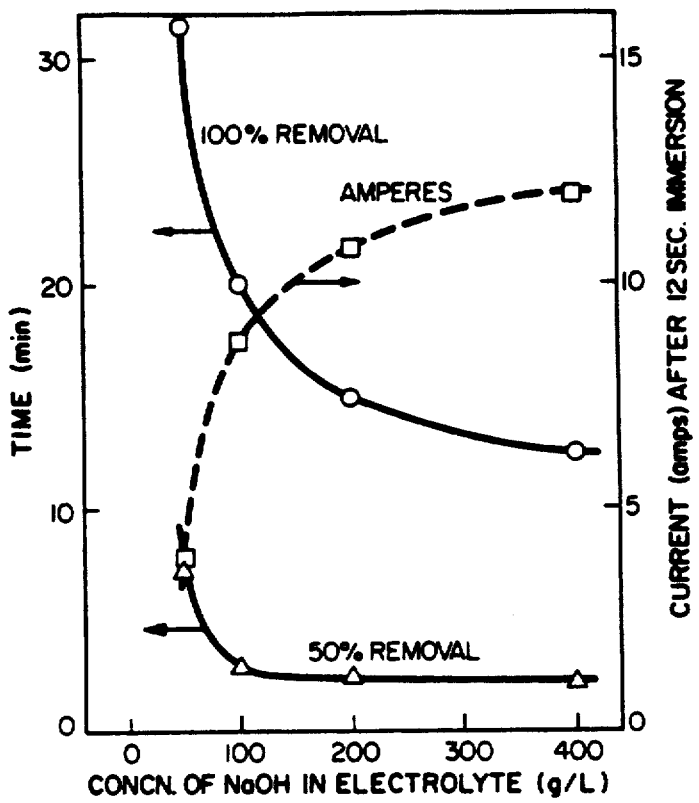
FIG. 3 illustrates the effect of caustic concentration on the rate of zinc dissolution.

Effect of Caustic Concentration—Experiments were performed as described above for sodium hydroxide concentrations between 10 and 400 gpl. A fresh 900 ml electrolyte sample was used for each experiment, and the temperature was held constant at 60° C. The electrolyte was agitated by pumped recirculation. Results at 50 gpl NaOH and above are recorded in FIG. 3.

At a sodium hydroxide concentration of 10 gpl, the maximum dissolution current was 0.13 amperes and the dissolution reaction showed no indication of completion after 60 minutes. At 50 gpl NaOH the reaction rate was significantly increased, with total dissolution requiring 31 minutes. This rate increased rapidly as the NaOH concentration was increased to 200 gpl, but the beneficial effect of further concentration increases was relatively small. This suggests that the optimum concentration lies between 200 and 300 gpl.

Example 4

Effect of Zincate Concentration—It is well known that increasing concentration of zincate ions will tend to decrease the potential which is available to drive zinc into solution, when zinc is corroding in caustic electrolyte. For cost reasons, it is desirable to operate the method of this invention at the highest zincate concentration which is consistent with acceptable reaction rates.

Electrolyte samples of different zincate concentration were prepared by dissolving a calculated amount of zinc oxide in sodium hydroxide. Further sodium hydroxide was then added to achieve the desired NaOH concentration of 200 gpl. Experiments were performed at 60° C., and the electrolyte was agitated by pumped recirculation. The experimental arrangement was otherwise identical to examples 1 to 3 above.

Figure 4:
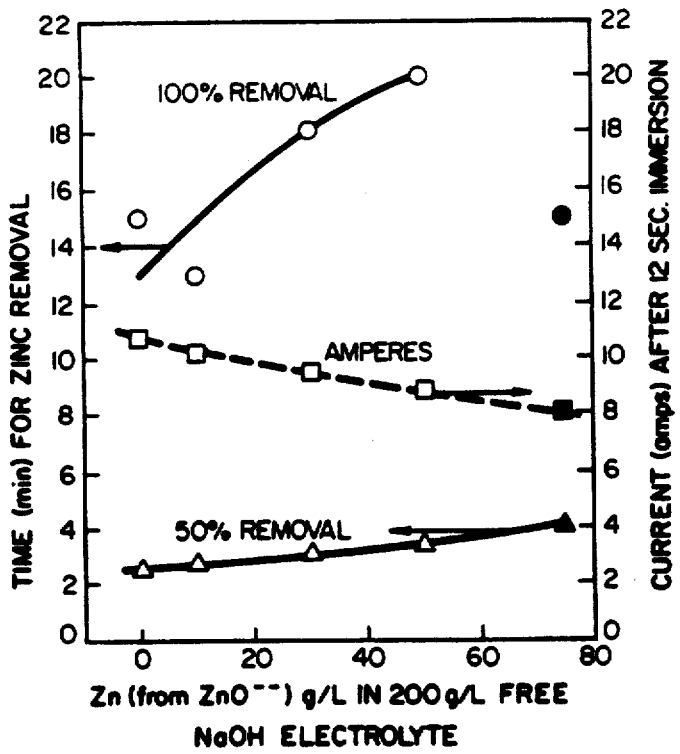
FIG. 4 illustrates the effect of zincate concentration in solution on the rate of zinc dissolution.

Results are summarized in FIG. 4. Increased zincate ion concentration (expressed in FIG. 4 in terms of the contained zinc) depresses the rate of the zinc dissolution reaction.

The experiment performed at 75 gpl zincate (expressed in terms of zinc) suggests that there is an increased effect of agitation at high zincate levels. The electrolyte in this case was mechanically agitated, resulting in a faster reaction rate than was obtained at 50 gpl zincate (as zinc).

Example 5

Co-Dissolution of Iron—Iron is expected to be largely immune to corrosion during the zinc dissolution process, but some iron dissolution on oxidation could be expected after zinc removal is complete. To test this, thirty-nine sequential experiments were performed as described in the preceding examples, using the same 900 ml of caustic soda electrolyte. Analysis of the electrolyte at the conclusion of this experiment gave the following result:

| Element | Concentration | Loss Compared with Zinc Dissolved |
|---|---|---|
| Zinc | 34.6 gpl | 100% |
| Iron | 0.65 mgpl | 0.0019% |

Thus, co-dissolution of iron is negligible when zinc is removed from galvanized scrap by the method of this invention.

Example 6

Figure 5:
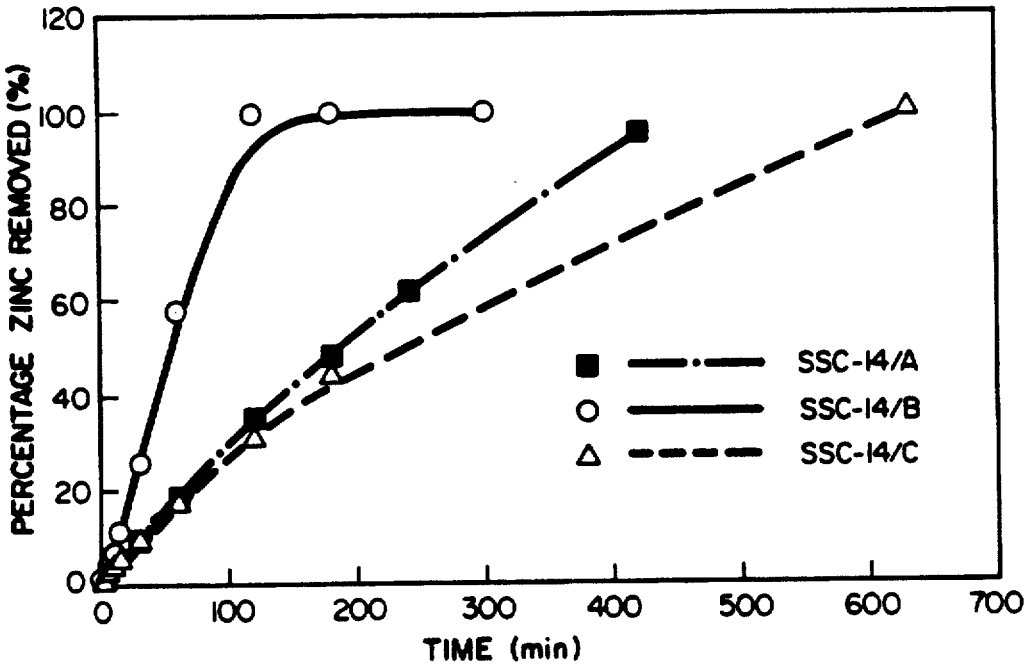
FIGS. 5 and 6 illustrate the percentage and weight, respectively, of zinc removed as a function of time from various galvanized steel coupons mounted in a nickel basket in 7M NaOH electrolyte.
Figure 6:
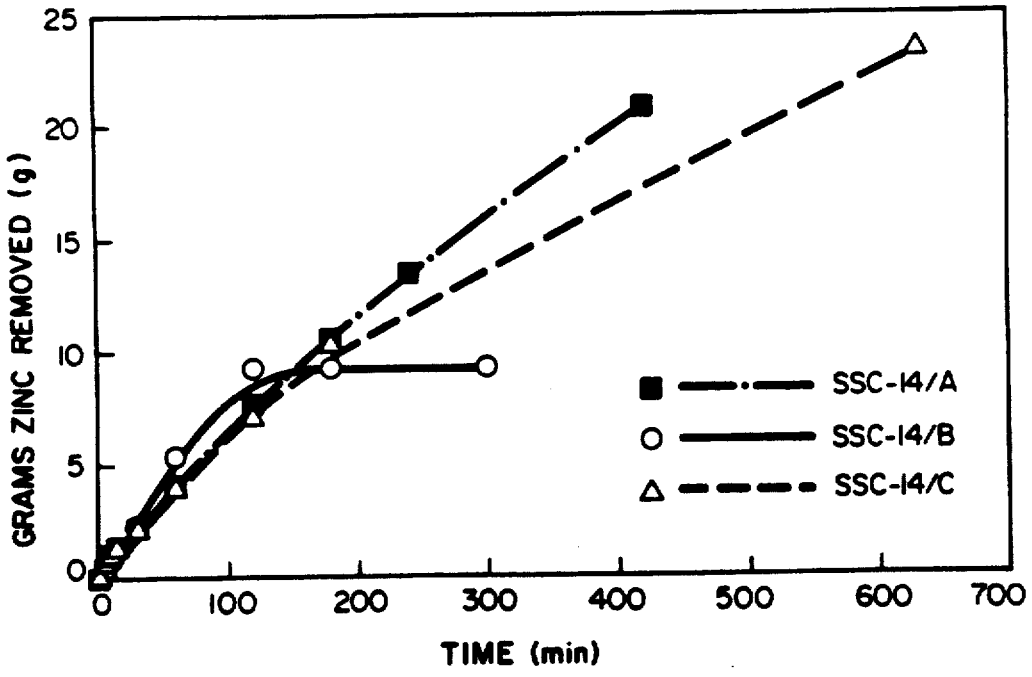

Effect of Galvanized Steel Type—The galvanic dezincing process can be used with any commercial grade of galvanized steel. The following experiments were performed with electrogalvanized steel sheet of 0.36 mm thickness having average zinc weight of 2.2% (SSC-14/A); galvannealed steel sheet of 0.32 mm thickness having average zinc weight of 0.93% (SSC-14/B); and hot-dipped galvanized sheet of 0.31 mm thickness having average zinc weight of 2.3% (SSC-14/C). 0.7 kg of each material was sheered into ¼-inch square coupons which were placed into a rectangular basket fabricated from nickel mesh. In each case, the basket was immersed in 7 molar caustic soda electrolyte which was maintained at 20° C. Raney-nickel-type active cathodes (material NE-C-200 described in Int. J. Hydrogen Energy, Vol. 10, No. 1, pp 11-19, 1985) were arrayed on both sides of the basket, and connected electrically to it. Essentially complete zinc removal was achieved in each case. The proportion of zinc removed for each material as a function of time in these experiments is shown in FIG. 5, while the zinc weight removed is shown in FIG. 6.

This invention is of course not limited in any way to the conditions of the examples described above. For example, all of the examples have been carried out in a batch-wise fashion However, a continuous process could be envisaged, in which solution is continuously being passed from a tank in which zinc is being removed from galvanized scrap by the method of this invention to a tank in which zinc is being electrowon from the zincate solution. Methods of electrowinning zinc from zincate solutions are well known in the art, as described for example by C.C. Merrill and R.S. Lang in "*Experimental Caustic Leaching of Oxidized Zinc Ores and Minerals and the Recovery of Zinc from Leach Solutions*", U.S. Bureau of Mines Report of Investigations No. 6576, April 1964. In this way the method of this invention could be performed with the zincate level being held at an approximately constant level It would also allow the invention to be performed with no net consumption of caustic, as the overall reaction occurring in the electrowinning of zinc from zincate solution is $$ZnO_2^- + H_2O \rightarrow Zn + \tfrac{1}{2}O_2 + 2OH^- . \quad (4)$$

Combining this with the dissolution reaction (3) shows that the overall process is simply electrolysis of water, according to $$H_2O \rightarrow H_2 + \tfrac{1}{2}O_2 . \quad (5)$$

Similarly, the batch-wise addition and removal of galvanized scrap to the caustic solution is only one embodiment of this invention. A system could be envisaged in which the scrap is carried in and out of the solution on a continuous belt, with the residence time being calculated to give the desired degree of zinc removal. In all of these embodiments, electrical connection between the galvanized scrap and the cathode material can either be by direct contact within the aqueous electrolyte, or by external connection. Also, it is clear that this method could be practised in a wide range of electrolytes having pH's between 11 and 15.5. Sodium hydroxide and potassium hydroxide are, however, the most suitable candidates, because of their ready availability and low cost.

We claim:

1. A method of removing zinc from galvanized steel without substantial co-dissolution of substrate iron comprising immersing the galvanized steel in a caustic electrolyte solution selected from caustic soda solution and caustic potash solution, at a pH between 11 and 15.5, and electrically connecting the galvanized steel to a cathode material without application of an external source of voltage to said cathode material, said cathode material being stable in caustic electrolyte and having a low hydrogen overvoltage.

2. A method as defined in claim 1, where the cathode is a material exhibiting a hydrogen overvoltage, at current densities on the order of 100 mA per square centimeter, of less than 150 millivolts, said material being selected from the materials including Raney nickels and other very-high surface area nickel materials and very high surface area nickel alloys, Raney cobalts and other very high surface area cobalt materials and very high surface area cobalt alloys.

3. A method as defined in claim 2 wherein the hydrogen over voltage is less than 100 mV.

4. A method as defined in claim 2, wherein the nickel alloy is selected from nickel aluminum alloy and nickel molydbate.

5. A method as defined in claim 2, wherein the nickel material is nickel sulfide.

6. A method as defined in claim 1, where the electrolyte temperature is between 15° C. and 80° C.

7. A method as defined in claim 6, where the electrolyte temperature is between 50° C. and 75° C.

8. A method as defined in claim 1, where the zincate concentration in the caustic electrolyte is maintained between zero and 50 grams per liter (zinc equivalent).

9. A method as defined in claim 1, wherein zinc is subsequently recovered from the electrolyte solution by electrowinning.

10. A method as defined in claim 9, where zinc is removed from galvanized steel to an electrolyte solution in a dezincing step, zinc is stripped from the electrolyte solution in an electrowinning step, and the electrolyte is returned to the dezincing step.

* * * * *